US007012591B2

(12) United States Patent
Chen et al.

(10) Patent No.: US 7,012,591 B2
(45) Date of Patent: Mar. 14, 2006

(54) APPARATUS FOR CONVERTING A DIGITAL SIGNAL TO AN ANALOG SIGNAL FOR A PIXEL IN A LIQUID CRYSTAL DISPLAY AND METHOD THEREFOR

(75) Inventors: Li-Yi Chen, Nantou (TW); Chen-Lung Kuo, Tainan (TW)

(73) Assignee: Chi Mei Optoelectronics Corp., Tainan (TW)

( * ) Notice: Subject to any disclaimer, the term of this patent is extended or adjusted under 35 U.S.C. 154(b) by 354 days.

(21) Appl. No.: 10/279,956

(22) Filed: Oct. 25, 2002

(65) Prior Publication Data

US 2003/0080931 A1 May 1, 2003

(30) Foreign Application Priority Data

Oct. 25, 2001 (TW) ..... 90126466 A

(51) Int. Cl.
*G09G 3/36* (2006.01)

(52) U.S. Cl. ..... 345/88; 345/690

(58) Field of Classification Search ..... 345/87, 345/88, 211, 212, 690, 98, 99, 204; 382/167
See application file for complete search history.

(56) References Cited

U.S. PATENT DOCUMENTS 5,696,840 A * 12/1997 Usami ..... 382/167
5,940,058 A * 8/1999 Koyama ..... 345/89
6,061,046 A * 5/2000 An ..... 345/98
6,256,010 B1 7/2001 Chen et al.
6,628,261 B1 * 9/2003 Sato et al. ..... 345/99
6,795,063 B1 * 9/2004 Endo et al. ..... 345/204
2002/0126106 A1 * 9/2002 Naito ..... 345/204
2003/0030631 A1 * 2/2003 Chen et al. ..... 345/211
2003/0080931 A1 * 5/2003 Chen et al. ..... 345/88
2003/0122754 A1 * 7/2003 Bu ..... 345/87
2003/0122757 A1 * 7/2003 Bu ..... 345/87
2004/0075674 A1 * 4/2004 Bu ..... 345/690
2004/0217981 A1 * 11/2004 Bu ..... 345/690

FOREIGN PATENT DOCUMENTS

TW 369771 9/1999

* cited by examiner

*Primary Examiner*—Amare Mengistu
(74) *Attorney, Agent, or Firm*—Rabin & Berdo, P.C.

(57) ABSTRACT

An apparatus for converting a digital pixel signal to a gamma voltage signal for a pixel in a liquid crystal display (LCD), wherein the digital pixel signal corresponds to the pixel. The apparatus includes a pixel signal converting unit for converting the digital pixel signal to a converted pixel signal and a gamma correction unit coupled to the pixel signal converting unit for outputting the gamma voltage signal according to the converted pixel signal. The relation between the digital pixel signal and the converted pixel signal is determined according to a display color of the pixel.

39 Claims, 7 Drawing Sheets

APPARATUS FOR CONVERTING A DIGITAL SIGNAL TO AN ANALOG SIGNAL FOR A PIXEL IN A LIQUID CRYSTAL DISPLAY AND METHOD THEREFOR

This application incorporates by reference Taiwan application Serial No. 090126466, filed Oct. 25, 2001.

BACKGROUND OF THE INVENTION

1. Field of the Invention

The invention relates in general to an apparatus for converting a digital signal to a corresponding analog signal and a method thereof, and more particularly to an apparatus for converting a digital pixel signal to a corresponding analog voltage signal for a liquid crystal display and a method thereof.

2. Description of the Related Art

Featuring the favorable advantages of thinness, lightness, and generating low radiation, liquid crystal displays (LCDs) have been widely used. The LCD panel includes a number of pixels, and the light transmittance of each pixel is determined by the voltage difference between the upper plate voltage and the lower plate voltage. The light transmittance of every pixel is typically non-linear with respect to the voltage applied across the pixel. Thus, gamma correction is performed to reduce color distortion by adjusting the lightness or darkness of pixels of the LCD panel.

FIG. 1 shows the gamma relation between the gamma voltage applied to a pixel and the luminance of the pixel. The X-axis represents the gamma voltage applied to the pixel, that is, the voltage difference between the upper plate and the lower plate voltages and the Y-axis represents the light transmittance of the corresponding pixel (T). When the magnitude of the upper plate voltage is fixed at a value, for example, Vcom, the voltage difference between the upper plate voltage and lower plate voltage is determined by the magnitude of the lower plate voltage. The corresponding relation between the lower plate voltage and the light transmittance of the pixel is nonlinear, as shown by the gamma curve in FIG. 1.

In addition, the gamma curve is symmetric with respect to the voltage of Vcom because the light transmittance of the pixel relates to the voltage across the pixel and is independent of the polarities of the voltages applied to the pixel. If two gamma voltages with the same magnitude but opposite polarities, for example, a positive gamma voltage Va and a negative gamma voltage Vb, are individually applied to the pixel, the light transmittance of the pixel is identical (TO). In other words, if the upper plates of two pixels are supplied with the voltage Vcom and the lower plate of one pixel is supplied with the voltage Va and the lower plate of another pixel is supplied with the voltage Vb, the luminance of the two pixels will be identical.

The liquid crystal molecules may deteriorate if a pixel of the LCD panel is supplied with voltages in the same polarity continually. Hence, the liquid crystal molecules can be protected by applying voltages in opposite polarity alternately across the upper and lower plates for each pixel. In other words, when a pixel has to emit at a luminance continuously, voltages in opposite polarities can be applied across the upper and the lower plates alternately by changing two different voltages across the upper and lower plates for the pixel alternately. In this way, deterioration of the pixel can be avoided.

FIG. 2 shows a block diagram of a nonlinear digital-to-analog converter (D/A converter) 202. The driving circuit of the liquid crystal display includes a nonlinear digital-to-analog converter 202 for converting the digital pixel signal (DATA) to the corresponding analog gamma voltage signal (OUT). Since the relation between the luminance of the pixel and the gamma voltage is not linear, the corresponding relation between digital pixel signal (DATA) and the analog gamma voltage signal (OUT) is determined according to the gamma curve. This process is called gamma correction. The corresponding relation between the digital pixel signal (DATA) and the luminance of the pixel is then approximated as linear by executing the gamma correction using the nonlinear digital-to-analog converter 202.

FIG. 3 shows a gamma curve, which is for use in the nonlinear digital-to-analog converter to perform gamma correction. The X-axis represents the data value of the digital pixel signal and the Y-axis represents the gamma voltage signal. The gamma curve shown in FIG. 3 includes a positive polarity gamma curve 404 and a negative polarity gamma curve 402. Each digital pixel signal corresponds to a positive polarity gamma voltage signal on the positive polarity gamma curve 404 or a negative polarity gamma voltage signal on the negative polarity gamma curve 402. The points A, B, C, D and E chosen from the positive polarity gamma curve 404 and the points A', B', C', D' and E' chosen from the negative polarity gamma curve 402 are specific reference points. According to the gamma curve shown in FIG. 3, each reference point corresponds to a reference gamma voltage signal (GMV) and a reference digital pixel signal. When performing the gamma correction, the nonlinear digital-to-analog converter 202 converts each digital pixel signal to the corresponding gamma voltage signal by interpolation according to the relationship between the reference gamma voltage signal (GMV) and the corresponding reference digital pixel signal.

FIG. 4 shows a conventional apparatus for outputting the gamma voltage signals according to the reference gamma voltage signals, wherein the conventional apparatus for outputting the gamma voltage signals includes two strings of resistors. Each resistor string includes 255 resistors (R0~R254), five input nodes (V0~V4, V5~V9) for receiving the reference gamma voltage signals, and 256 output nodes for outputting the gray level voltage signals. When the gamma correction is executed, the gamma output voltage signal corresponding to the digital pixel signal can be determined according to the gray level voltage signals.

FIG. 5 shows the diagram of the pixel P(N,M). The driving circuit of the pixel P(N,M) includes a thin film transistor T(N,M) and a pixel capacitor C(N,M). The gate electrode of the transistor T(N,M) is coupled to the scan line (SN) $S_N$; the source electrode of the transistor T(N,M) is coupled to the data line (DM) $D_M$; and the drain electrode of the transistor T(N,M) is coupled to the pixel capacitor C(N,M). When the transistor T(N,M) is turned ON through enabling the scan line $S_N$, the gamma voltage output signal is delivered to the pixel capacitor C(N,M) through the data line $D_M$ and the transistor T(N,M). The luminance of the pixel P(N,M) can be determined by data value of the gamma voltage output signal.

In a color LCD, a picture frame is displayed based on a pixel element, called a color pixel or pixel simply, including three sub-pixels for displaying primary colors, that is, red, green, and blue. The three sub-pixels of a color pixel are supplied with separate gamma voltage signals outputted by the driving circuit of the color LCD after gamma correction. The pixel can thus display different colors by changing the brightness of the three sub-pixels individually.

FIG. 6 shows three different gamma curves, marked "R", "G", and "B", for the primary colors, red, green, and blue, respectively. According to the "R", "G", and "B" gamma curves, the gamma voltages corresponding to the maximum luminance of the sub-pixels are $V_{RM}$, $V_{BM}$, and $V_{GM}$ for red, blue, and green respectively. The magnitude of $V_{BM}$ is smaller than that of $V_{GM}$, and $V_{GM}$ is smaller than $V_{RM}$ ($V_{BM}<V_{GM}<V_{RM}$). The nonlinear digital-to-analog converter conventionally predetermines the maximum magnitude of the gamma voltage signal to be $V_{BM}$ for gamma correction. Based on this magnitude of $V_{BM}$,all other gamma voltage signals corresponding to the digital pixel signals are determined. Therefore, the relation between digital pixel signals and the corresponding gamma voltage signals is fixed and independent of the display color of the pixel corresponding to the digital pixel signal. Unfortunately, this conventional gamma correction method disadvantageously causes the luminance of a pixel being unable to reach its maximum value when the display color of the pixel is red or green, because the maximum magnitude of the gamma voltage signal is set to $V_{BM}$ while $V_{BM}$ is smaller than that of $V_{GM}$ and $V_{GM}$ is smaller than $V_{RM}$ ($V_{BM}<V_{GM}<V_{RM}$). In this way, optimum display quality of the LCD panel becomes unachievable and the display performance would be degraded.

SUMMARY OF THE INVENTION

It is therefore an object of the invention to provide an apparatus for converting a digital pixel signal to a corresponding gamma voltage signal and a method therefor so as to enable the pixels of a display panel to achieve optimum brightness in displaying different colors. If the digital pixel signal indicates its maximum gray level for a sub-pixel of a specific primary color, the sub-pixel display color can reach its maximum luminance for that color. In this manner, the brightness of the whole display panel can be optimally improved, enhancing the performance of the display panel.

Additionally, another object of the invention is to reduce the response speed of the pixel while improve the brightness of each pixel, thus reducing the reaction time of the pixel and further enhancing the performance of the display panel.

The invention achieves the object identified above by providing an apparatus for converting a digital pixel signal to a gamma voltage signal for enabling a pixel in a liquid crystal display (LCD), wherein the digital pixel signal corresponds to the pixel. The apparatus of the invention includes a pixel signal converting unit for converting the digital pixel signal to a converted pixel signal and a gamma correction unit coupled to the pixel signal converting unit for converting the converted pixel signal into the gamma voltage signal and outputting the gamma voltage signal. The gamma correction unit can perform the gamma correction on the basis of a number of reference gamma voltage signals, for example. The conversion between the digital pixel signal and the converted pixel signal is determined according to a display color of the pixel. The relation between the converted pixel signal and the gamma voltage signal can be determined by using the relationship between a number of reference gamma voltage signals and the corresponding reference digital pixel signals.

According to the object of the invention, a method for converting a digital pixel signal to a gamma voltage signal is provided, wherein the digital pixel signal corresponds to a pixel in a display panel. First, the digital pixel signal is received. Second, the digital pixel signal is converted to a converted pixel signal, wherein the relation between the digital pixel signal and the converted pixel signal is determined according to the display color of the pixel. Next, the converted pixel signal is converted to the gamma voltage signal by performing gamma correction. The gamma voltage signal is finally outputted.

According to the another object of the invention, a method for converting a digital pixel signal to a gamma voltage signal for a pixel in a display panel is provided, wherein the gamma voltage signal is used for applying to a pixel after a last gamma voltage signal is applied to the pixel, and the last gamma voltage corresponds to a last digital pixel signal. The method includes the following steps. First, the digital pixel signal is received. If the digital pixel signal and the last digital pixel signal are different in value, the digital pixel signal is converted to the converted pixel signal equal to a dynamic converted pixel signal, wherein the relation between the digital pixel signal and the dynamic converted pixel signal is determined according to a display color of the pixel, the digital pixel signal, and the last digital pixel signal. If the digital pixel signal and the last digital pixel signal are equal in value, the digital pixel signal is converted to the converted pixel signal equal to a static converted pixel signal according to the value of the digital pixel signal, wherein the relation between the digital pixel signal and the static converted pixel signal is determined according to the display color of the pixel. After that, the converted pixel signal is converted to the gamma voltage signal, for example, by performing gamma correction on the basis of a number of reference gamma voltage signals. The gamma voltage signal is then outputted.

Other objects, features, and advantages of the invention will become apparent from the following detailed description of the preferred but non-limiting embodiments. The following description is made with reference to the accompanying drawings.

DETAILED DESCRIPTION OF THE INVENTION

The feature of the present invention is that the display color of the sub-pixel corresponding to the digital pixel signal is involved in converting the digital pixel signal into a converted pixel signal for gamma correction. The relation between each digital pixel signal and the corresponding analog gamma voltage signal is determined according to the specific gamma curve for the specific primary color. In this manner, all pixels, regardless of the display color, can reach its maximum luminance. Thus, the performance of the display panel can be improved.

First Embodiment

Figure 7:
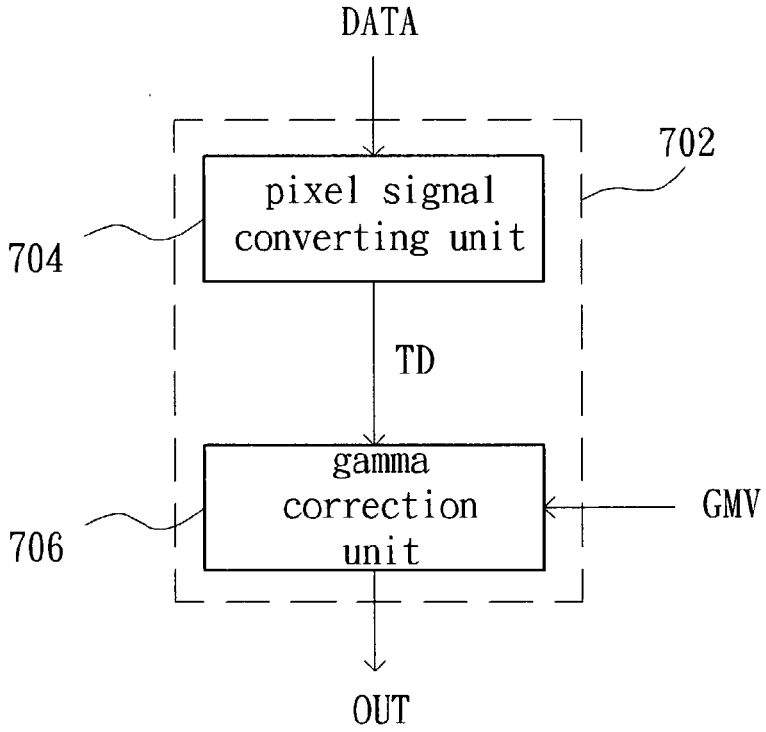
FIG. 7 shows a block diagram of a digital-to-analog converting apparatus according to a first embodiment of the present invention.

FIG. 7 shows the block diagram of the digital-to-analog converting apparatus according to the first embodiment of the present invention. The digital-to-analog converting apparatus 702 is for use in the driving circuit of the liquid crystal display for converting the digital pixel signal to the corresponding gamma voltage signal. The digital-to-analog converting apparatus 702 can thus be employed to substitute for the conventional nonlinear digital-to-analog converting unit in order to obtain improved display performance. The digital-to-analog converting apparatus 702 includes a pixel signal converting unit 704 for converting the digital pixel signal (DATA) to the corresponding converted pixel signal (TD) and a gamma correction unit 706 for executing gamma correction to convert the converted pixel signal (TD) into a gamma voltage signal (OUT) and output the gamma voltage signal (OUT), wherein the gamma correction unit 706 is coupled to the pixel signal converting unit 704. In addition, the gamma voltage signals (OUT) outputted by the gamma correction unit 706 form a range, which can be referred to as a gamma voltage signal range, with respect to the display color of the pixel, for example, the display color of the respective sub-pixel of a color pixel in a display panel. Each range includes a gamma voltage signal which enables the pixel to display the display color in the maximum luminance of the pixel. The gamma correction unit 706 can perform the gamma correction on the basis of a plurality of reference gamma voltage signals. The gamma correction unit 706 converts the converted pixel signal into the gamma voltage signal, for example, according to the relationship between the reference gamma voltage signals and their corresponding reference digital pixel signals. In this case, the reference gamma voltages can be applied to the gamma correction unit 706.

Figure 8:
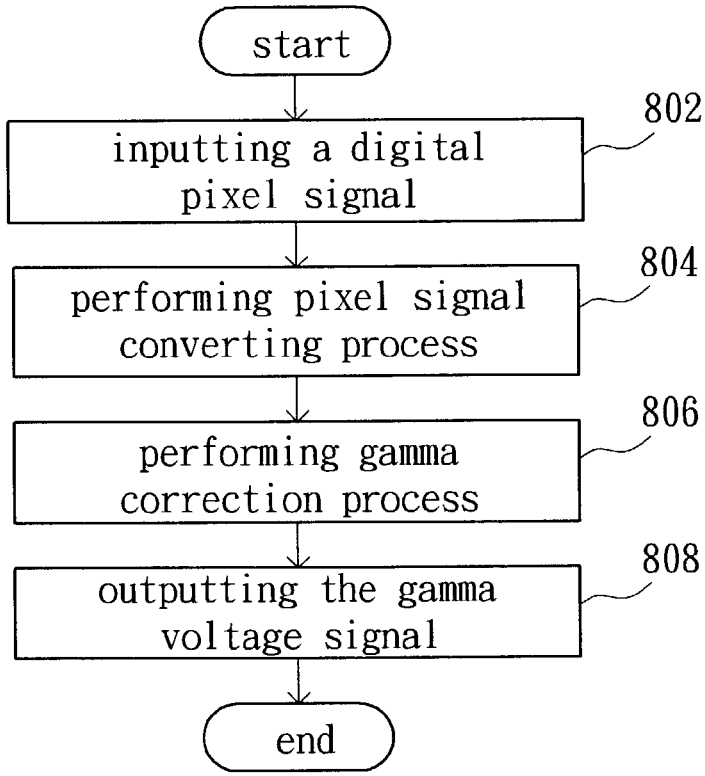
FIG. 8 shows a flow chart of a gamma correction method executed by the digital-to-analog converting apparatus shown in FIG. 7.

FIG. 8 shows the flow chart of the gamma correction method executed by the digital-to-analog converting apparatus shown in FIG. 7. The gamma correction method of this embodiment includes the following steps. First, the digital pixel signal (DATA) is inputted into the digital-to-analog converting apparatus 702, as indicated in step 802. The pixel signal converting process is then performed in step 804 to convert the digital pixel signal (DATA) into a converted pixel signal (TD) by, for example, the pixel signal converting unit 704. Next, the gamma correction process is performed in step 806. In step 806, the converted pixel signal is fed into the gamma correction unit 706 to output the corresponding gamma voltage signal (OUT). Finally, in step 808, the gamma voltage signal (OUT) is outputted.

The following is to describe the pixel signal converting process in step 804 in details. Suppose each digital pixel signal (DATA) and each corresponding converted pixel signal (TD) are eight-bit binary signals. As mentioned above, the relation between the digital pixel signal (DATA) and the corresponding converted pixel signal (TD) is determined according to the display color of the corresponding sub-pixel. For example, two digital pixel signals (DATA) indicative of the same data value may correspond to two different converted pixel signals (TD) if the display colors of the corresponding sub-pixels are different.

Figure 9:
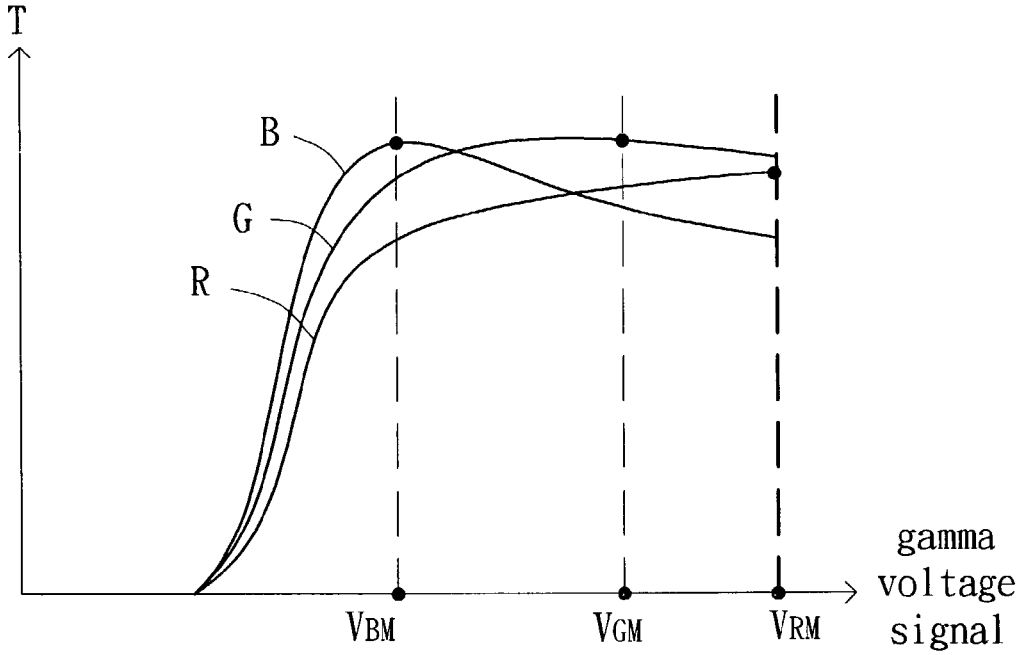
FIG. 9 shows three different gamma curves for red, blue, and green respectively.

FIG. 9 shows three different gamma curves, marked "R", "G", and "B", for red, green, and blue respectively. Each color corresponds to the specific gamma curve. According to the "R", "G", and "B" gamma curves, the gamma voltage corresponding to the maximum luminances for red, blue, and green are $V_{RM}$,$V_{BM}$,and $V_{GM}$ respectively. The magnitude of $V_{BM}$ is smaller than $V_{GM}$,and $V_{GM}$ is smaller than $V_{RM}$ ($V_{BM}<V_{GM}<V_{RM}$). The maximum magnitude of the gamma voltage signal can be set to $V_{RM}$ instead of $V_{BM}$, according to the present invention. All other gamma voltage signals corresponding to the digital pixel signals are determined based on the magnitude of $V_{RM}$. In addition, the relation between each digital pixel signal and the corresponding analog gamma voltage signal relates to the display color of the corresponding sub-pixel.

The pixel signal converting process can be performed by using a mapping table in the pixel signal converting unit 704, wherein the mapping table stores data for relating 6-bit binary digital pixel data to their corresponding 6-bit binary converted pixel data. As described above, the pixel signal converting process in step 804 is performed to convert the digital pixel signals DATA for the sub-pixels for displaying primary colors, that is, red sub-pixel, green sub-pixel, and blue sub-pixel, into the corresponding converted pixel signals individually. The purpose of performing the pixel converting process is to adjust the digital pixel signal to the gamma correction process, that is, to make a signal to be fed into the gamma correction unit 706 obey a rule. In other words, the digital pixel signals DATA for sub-pixels displaying different colors, as well as the relations between the gamma voltages and luminance of the different sub-pixels, are different but the corresponding converted pixel signal TD of the digital pixel signals DATA can obey a rule that, for example, the magnitude of the gamma voltage signal increases with data value indicated by the converted pixel signal.

As can be examined in FIG. 9, the relation between the gamma voltages and luminance of the red sub-pixels obeys this rule. The pixel converting process can be designed based on this case.

When the maximum magnitude of the gamma voltage signal in the gamma correction process is set to $V_{RM}$,the relation between the gamma voltage signal and the luminance of the corresponding sub-pixel obeys the above rule if the display color of the corresponding sub-pixel is red. Therefore, when the pixel signal converting step 804 is performed for the digital pixel signal for the red sub-pixel, the magnitude of the converted pixel signal is set to the same as that of the digital pixel signal. Thus, the red sub-pixel can reach its maximum luminance when receiving the largest gamma voltage signal $V_{RM}$.

Figure 1:
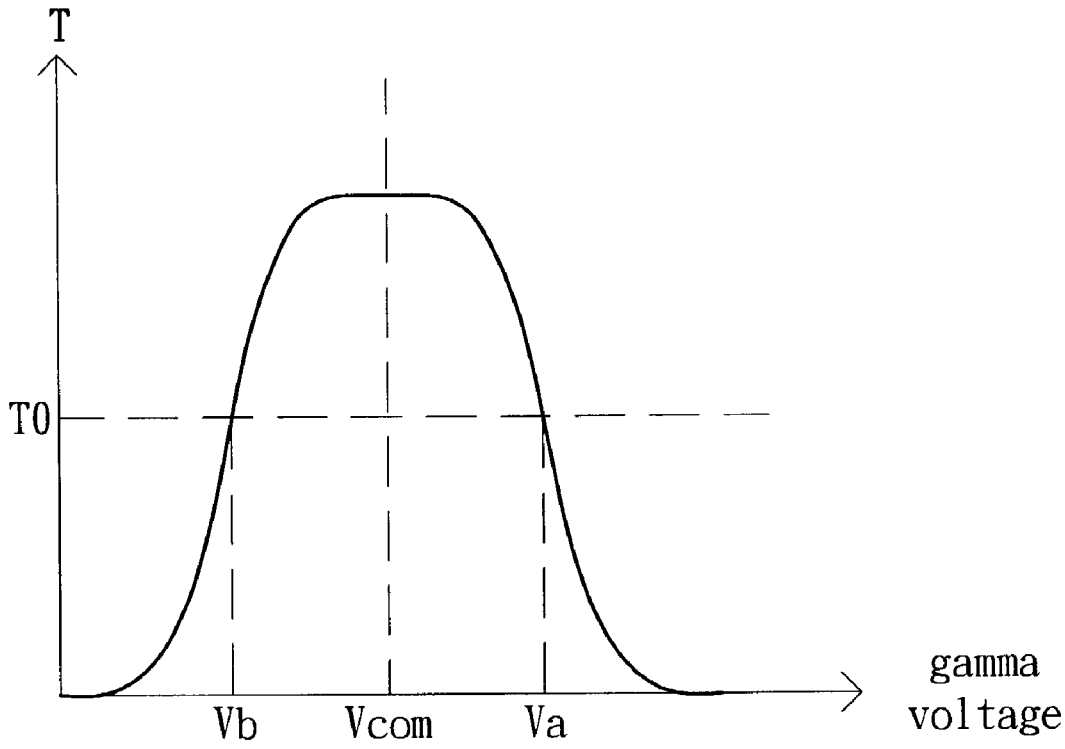
FIG. 1 (PRIOR ART)
FIG. 1 (Prior Art) shows the gamma relation between the gamma voltage and the luminance of a pixel.
Figure 2:
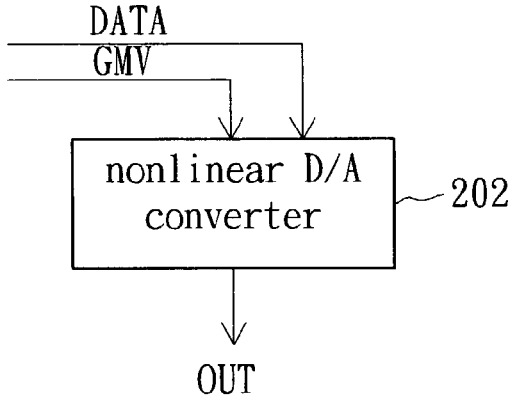
FIG. 2 (PRIOR ART)
FIG. 2 (Prior Art) shows the block diagram of a nonlinear digital-to-analog converter (D/A converter).
Figure 3:
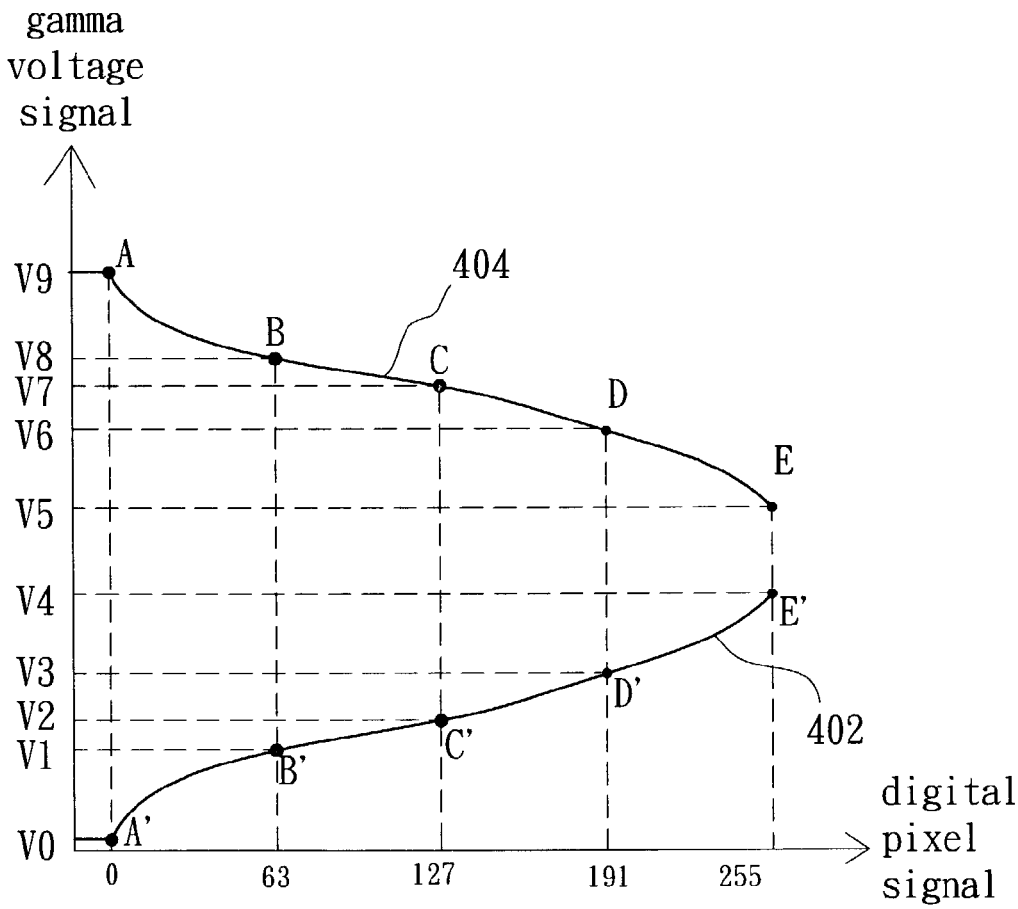
FIG. 3 (PRIOR ART)
FIG. 3 (Prior Art) shows a gamma curve, which is for use in the nonlinear digital-to-analog converter to perform gamma correction.
Figure 4:
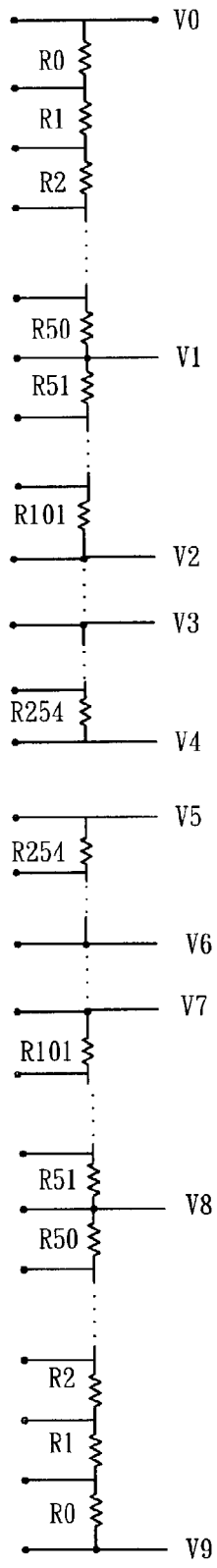
FIG. 4 (PRIOR ART)
FIG. 4 (Prior Art) shows a conventional apparatus for outputting the gamma voltage signals according to the reference gamma voltage signals.
Figure 5:
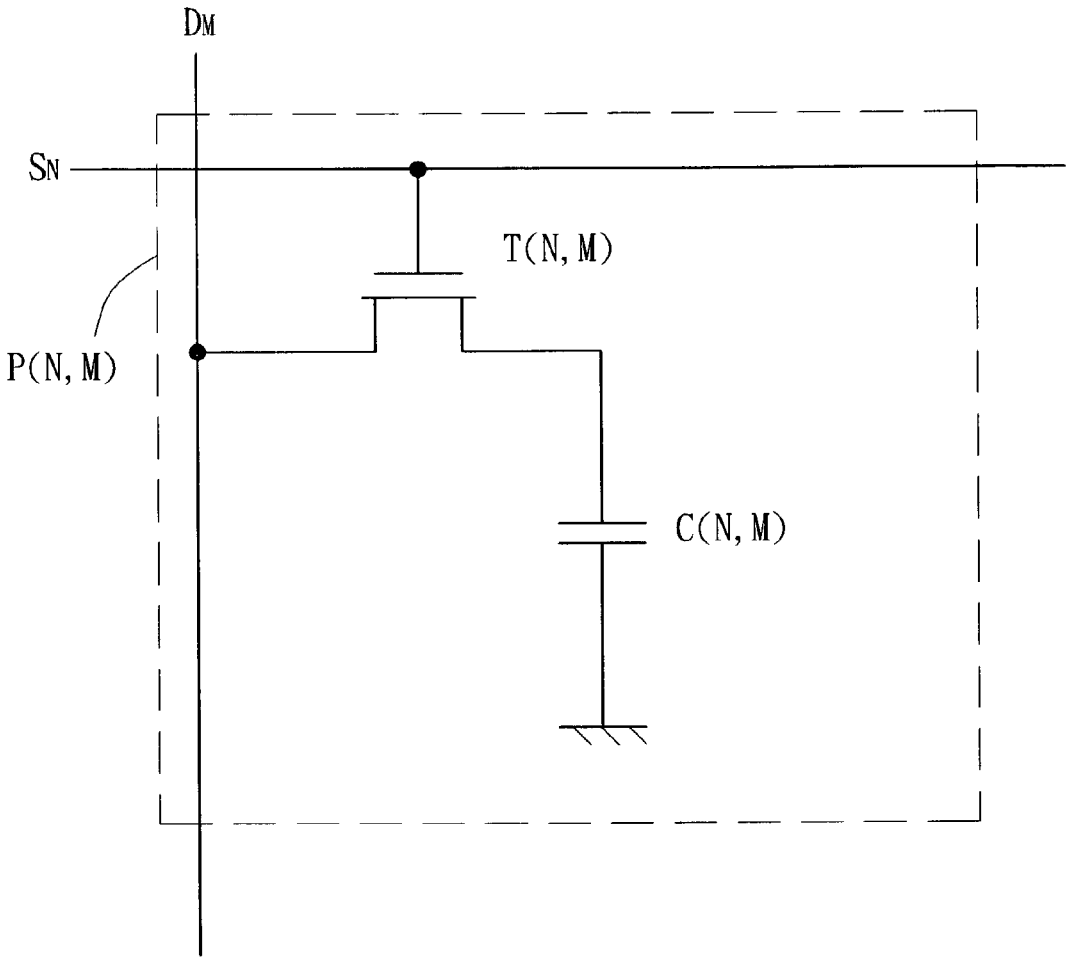
FIG. 5 (PRIOR ART)
FIG. 5 (Prior Art) shows the diagram of the pixel P(N,M).
Figure 6:
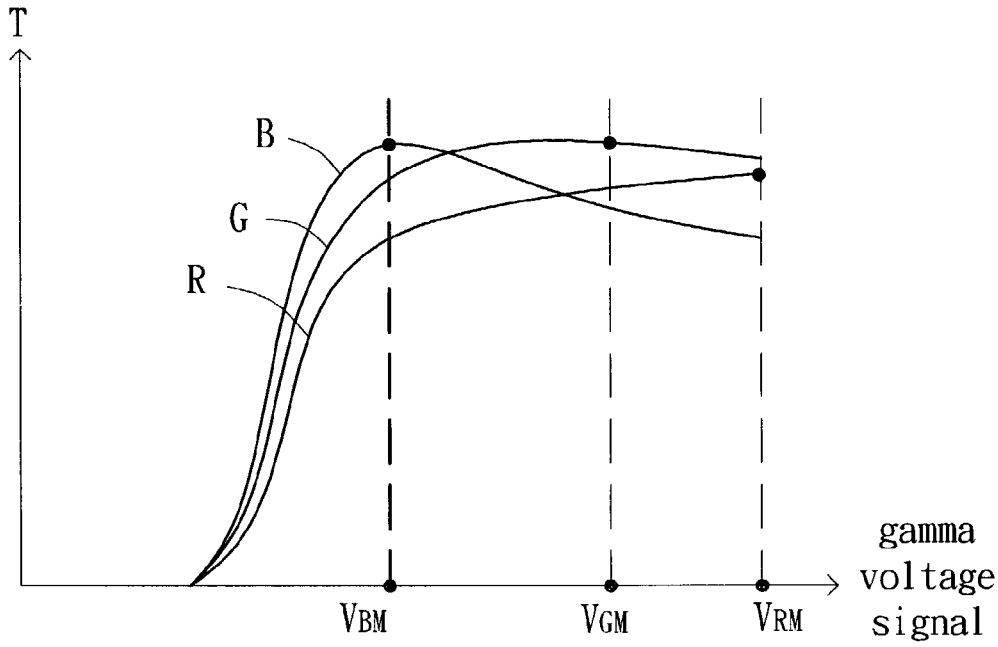
FIG. 6 (PRIOR ART)
FIG. 6 (Prior Art) shows three different gamma curves for red, blue, and green respectively.

As for the digital pixel signals to be applied to sub-pixels for displaying blue or green, the relation between the gamma voltage signal and the luminance of the corresponding sub-pixels, as indicated by the curves "B" or "G" in FIG. 6, does not obey the above mentioned rule if the maximum gamma voltage signal is predetermined to be $V_{RM}$. Take the gamma voltage signal for the green sub-pixel for example. When the magnitude of the gamma voltage signal is larger than $V_{GM}$, the luminance of the sub-pixel decreases with the gamma voltage signal. Therefore, the pixel signal converting process performed in the step 804 is to adjust the digital pixel signal for displaying blue or green to the gamma correction process based on the predetermined maximum gamma voltage $V_{RM}$. In other words, when the digital pixel signals correspond to blue or green sub-pixels, the pixel signal converting unit 702 converts these digital pixel signals pixel into corresponding converted pixel signals that obey the above rule.

The pixel converting method for converting digital pixel signals for green or blue sub-pixels into the corresponding converted pixel signals is to map the values indicated by these digital pixel signal onto corresponding ranges determined by the display color of the sub-pixels, wherein each range, which can be referred to as a converted pixel value range, has a maximum value that corresponds to the gamma voltage which enables the corresponding sub-pixel to achieve its maximum luminance. For example, the digital pixel signal corresponding to the gamma voltage signal $V_{RM}$ is set to indicate a maximum value of 255 in decimal so as to enable a red sub-pixel to achieve its highest transmittance. The value of a digital pixel signal corresponding to the gamma voltage signal $V_{GM}$ then must be converted into a number smaller than 255 (since $V_{GM}<V_{RM}$), for example, 240, in order to enable a green sub-pixel to reach its highest transmittance. When the pixel signal converting step 804 is performed and the digital pixel signals correspond to green sub-pixels, the digital pixel signals indicating numbers ranging from 0 to 255 can be converted into the converted pixel signals indicating numbers ranging from 0 to 240. Thus, the converted pixel signal for a green sub-pixel is set to indicate values within the range of 0 to 240 and the green sub-pixel obtains its maximum luminance when the corresponding converted pixel signal indicates a value of 240 .

When step 804 is performed, some digital pixel signals for green sub-pixels should be mapped onto the converted pixel signals indicating the same value because the range of gray values indicated by the converted pixel signal (from 0 to 240) for green sub-pixels is smaller than that indicated by the digital pixel signal (from 0 to 255) for red sub-pixels. The digital pixel signals of adjacent gray values that are difficult to be discriminated by human eyes can be mapped onto the converted pixel signals of the same value. The human eyes are difficult to discriminate the pixels that are nearly bright. For example, if the maximum gray level of a pixel is 255, human eyes are difficult to discriminate the pixel at 255 from the pixel at 254. Therefore, two digital pixel signals indicating adjacent gray levels, such as 255 and 254 can be mapped onto the same converted pixel signal, such as 240, when the two digital pixel signals correspond to green sub-pixels. Thus, the relation between each digital pixel signal for green sub-pixels and the corresponding converted pixel signal can be determined in this manner.

For the digital pixel signals corresponding to blue sub-pixels, the relation between each digital pixel signal and the corresponding converted pixel signal can be determined in the similar manner disclosed above. All these relations between each digital pixel signal and the corresponding converted pixel signal can be set in the mapping table in the pixel signal converting unit 704.

Hence, for a specific kind of primary color sub-pixels on the display panel, the corresponding converted pixel signals obtained as described above are within a respective range with a maximum value that corresponds to the gamma voltage that enables the corresponding sub-pixels to obtain their maximum luminance. The converted pixel signal is then fed into the gamma correction unit 706, as indicated in step 806, to convert the converted pixel signal to the corresponding gamma voltage signal. Thus, the gamma correction executed by the digital-to-analog converting apparatus of the first embodiment is accomplished. In this manner, the brightness of the whole display panel can be optimally improved, enhancing the performance of the display panel.

Second Embodiment

Figure 10:
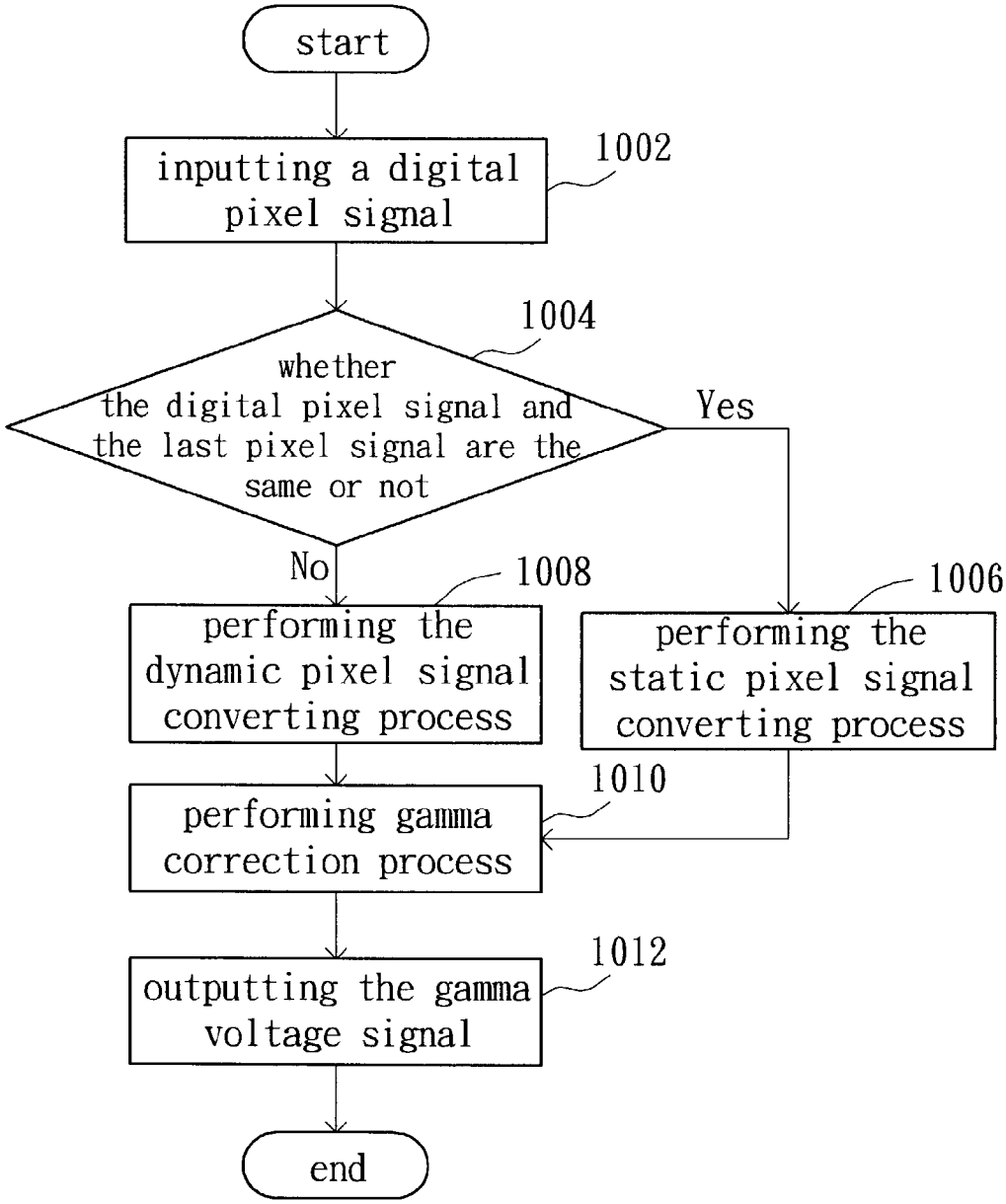
FIG. 10 shows a flow chart of the gamma correction method according to a second embodiment of the present invention.

FIG. 10 shows the flow chart of the digital-to-analog converting method according to the second embodiment of the present invention. The gamma correction method of the second embodiment of the invention includes the following steps.

First, in step 1002, the digital pixel signal (DATA) is inputted into the digital-to-analog converting apparatus 702. Step 1004 is then performed to determine whether the digital pixel signal needs to be converted into a converted pixel signal by dynamic conversion. In the second embodiment, the pixel signal converting process includes a dynamic converting process 1008 and a static converting process 1006. The dynamic converting process and the static converting process are disclosed in the following specification.

Because of the physical characteristics of the liquid crystal molecules, it takes a reaction time for the pixel to change its luminance when the magnitude of the receiving gamma voltage signal changes. The reaction time affects the response speed of the pixel in changing to the desired brightness. The longer the reaction time is, the slower the response speed becomes. The conventional method for increasing the response speed of the pixel is referred to as overdrive and is described as follows. When the luminance of the pixel is changing from low luminance (LI) to high luminance (Lh), the response speed of the pixel is increased by applying an overdrive gamma voltage signal (OUT') higher than the gamma voltage (OUT) corresponding to the high luminance (Lh) to the pixel in the next frame. Since the magnitude of the overdrive gamma voltage signal (OUT')is larger than the ordinary gamma voltage signal (OUT), the luminance of the pixel can change from the low luminance (LI) to the high luminance (Lh) more rapidly and the reaction time of the pixel can be reduced. Conversely, when the luminance of the pixel is changing from the high luminance (Lh) to the low luminance (LI), the response speed of the pixel is increased by applying an overdrive gamma voltage signal (OUT')lower than the gamma voltage signal (OUT) corresponding to the low luminance (LI) in the next frame. Since the magnitude of the overdrive gamma voltage signal (OUT')is smaller than the ordinary gamma voltage signal (OUT), the luminance of the pixel can change from high luminance (Lh) to low luminance (LI) more rapidly and the reaction time of the pixel can be reduced.

In this embodiment of the present invention, the method of over-driving can be incorporated in determining the relation between each digital pixel signal and the corresponding converted pixel signal. For a sub-pixel, the converted pixel signal can be determined according to not only the digital pixel signal of the present frame (DATA) but also the digital pixel signal of the last frame (DATA'). This pixel data converting process is called the dynamic converting process.

When step 1004 is performed, the pixel signal converting unit 704 compares the digital pixel signal of the last frame (DATA') and that of the present frame (DATA) for the same corresponding pixel. If the value of the digital pixel signal of the present frame (DATA) is the same as that of the last frame (DATA'), the static converting process 1006 is performed. Otherwise, the dynamic converting process 1008 is performed.

The static converting process employed in the second embodiment is the same as the pixel signal converting process described in the first embodiment. The relation between each digital pixel signal and the corresponding analog gamma voltage signal is determined according to the specific gamma curve for the display color of the sub-pixel corresponding to the digital pixel signal. The relation between each digital pixel signal and the corresponding converted pixel signal is stored in the mapping table in the pixel signal converting unit 704.

The dynamic converting process 1008 is performed if the value of the digital pixel signal of the present frame (DATA) is different from that of the last frame (DATA'). If the value of the digital pixel signal of the present frame (DATA) is greater than that of the last frame (DATA'), the luminance of the corresponding pixel will change from low luminance to high luminance. In this case, the difference between the digital pixel signal of the present frame (DATA) and that of the last frame (DATA') indicates the overdrive converted pixel signal (TD') has a value larger than the ordinary converted pixel signal (TD) corresponding to the digital pixel signal of the present frame (DATA). The greater the difference is, the larger the value of the overdrive converted pixel signal has. When the gamma correction process of step 1010 is performed, the overdrive converted pixel signal (TD') is converted into an overdrive gamma voltage signal (OUT') that is larger than the ordinary gamma voltage signal (OUT) corresponding to the ordinary converted pixel signal (TD). The luminance of the pixel can thus change from low luminance to high luminance more rapidly and the reaction time of the pixel can be reduced. If the value of the digital pixel signal of the present frame (DATA) is smaller than that of the last frame (DATA'), the luminance of the corresponding pixel will change from high luminance to low luminance. The greater difference between the digital pixel signal of the present frame (DATA) and that of the last frame (DATA') signifies the smaller value of the overdrive converted pixel signal (TD'). The value of the overdrive converted pixel signal (TD')can be smaller than the ordinary converted pixel signal (TD) corresponding to the digital pixel signal of the present frame (DATA). In this case, when the gamma correction process of the process 1010 is performed, the magnitude of the overdrive gamma voltage signal (OUT')corresponding to the overdrive converted pixel signal (TD')must be smaller than the ordinary gamma voltage signal (OUT) corresponding to the ordinary converted pixel signal (TD). In step 1008, the overdrive converted pixel signal can be produced by, for example, using the mapping table in the pixel converting unit 704. Finally, the overdrive gamma voltage signal is outputted, as indicated in step 1012. Therefore, the luminance of the pixel can change from high luminance to low luminance more rapidly and the reaction time of the pixel can be reduced.

In the second embodiment, the relation between each digital pixel signal and the corresponding analog gamma voltage signal is determined according to not only the specific gamma curve for the display color of the sub-pixel corresponding to the digital pixel signal but also the digital pixel signal of the last frame for the same pixel. Therefore, the sub-pixels for different primary colors can reach their maximum luminance if the corresponding digital pixel signals indicate their maximum gray level values. Thus, the performance of the display panel can be improved and the reaction time of the pixel can be reduced.

As disclosed above, a sub-pixel of a specific primary color can reach its maximum luminance for the display color of the sub-pixel if the corresponding digital pixel signal indicating a maximum gray level is converted into a gamma voltage signal according to the invention for applying to the sub-pixel. In this manner, the brightness of the whole display panel can be optimally improved, enhancing the performance of the display panel. The maximum brightness of the pixels in displaying green and red can be respectively increased by about 5% and about 12% , as compared to the conventional method. In addition, the luminance of the whole LCD can be increased by about 10% to about 20% . Moreover, the overdrive method can be employed in the invention to increase the response speed of changing the brightness of the pixels, thus resulting in the reduction in response time of the pixels.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for converting a digital pixel signal to a gamma voltage signal for enabling a pixel for a display color in a liquid crystal display (LCD), the display color of the pixel being one of a group of colors, wherein the digital pixel signal corresponds to the pixel, the gamma voltage signal is for application to the pixel for displaying the display color with an intensity according to the gamma voltage signal, and a plurality of pixels of the LCD for displaying the respective colors reach respective maximum luminances at respective maximum gamma voltages for the respective colors, the apparatus comprising:

a pixel signal converting unit for converting the digital pixel signal to a converted pixel signal, wherein the relation between the digital pixel signal and the converted pixel signal is determined according to the display color of the pixel, the magnitude of the converted pixel signal has a range determined according to the display color of the pixel, the range of magnitude of the converted pixel signal with respect to the display color of the pixel depends on the maximum gamma voltage at which the pixel reaches the maximum luminance with respect to the display color of the pixel, and the maximum gamma voltages for the group of colors are not all the same; and a gamma correction unit coupled to the pixel signal converting unit for converting the converted pixel signal into the gamma voltage signal and outputting the gamma voltage signal, wherein when the converted pixel signal indicates a maximum value in the range of magnitude with respect to the display color of the pixel, the gamma voltage signal is the maximum gamma voltage at which the pixel reaches maximum luminance with respect to the display color of the pixel.

2. The apparatus according to claim 1, wherein the display color of the pixel is selected from the group consisting of red, blue, and green.

3. The apparatus according to claim 2, wherein the gamma correction unit outputs the gamma voltage signal forming a gamma voltage signal range with respect to the display color of the pixel, where the gamma voltage signal range includes:

a first gamma voltage signal that enables the pixel to display the display color in maximum luminance of the pixel if the display color of the pixel is red;

a second gamma voltage signal that enables the pixel to display the display color in maximum luminance of the pixel if the display color of the pixel is blue; and a third gamma voltage signal that enables the pixel to display the display color in maximum luminance of the pixel if the display color of the pixel is green.

4. The apparatus according to claim 3, wherein the value of the converted pixel signal is within a converted pixel value range determined by the display color of the pixel.

5. The apparatus according to claim 4, wherein the pixel signal converting unit converts the digital pixel signal into the converted pixel signal indicating a maximum value of the converted pixel value range if the digital pixel signal indicates a maximum value.

6. The apparatus according to claim 5, wherein the gamma correction unit converts the converted pixel signal indicating the maximum value of the converted pixel value range into the first gamma voltage signal if the display color of the pixel is red.

7. The apparatus according to claim 5, wherein the gamma correction unit converts the converted pixel signal indicating the maximum value of the converted pixel value range into the second gamma voltage signal if the display color of the pixel is blue.

8. The apparatus according to claim 5, wherein the gamma correction unit converts the converted pixel signal indicating the maximum value of the converted pixel value range into the third gamma voltage signal if the display color of the pixel is green.

9. The apparatus according to claim 1, wherein the digital pixel signal and the converted pixel signal are both n-bit binary data signals.

10. The apparatus according to claim 1, wherein the apparatus is set in a driving circuit of the liquid crystal display.

11. The apparatus according to claim 1, wherein the gamma correction unit converts the converted pixel signal into the gamma voltage signal on the basis of a plurality of reference gamma voltage signals.

12. The apparatus according to claim 1, wherein the pixel signal converting unit converts the digital pixel signal into the converted pixel signal so that the range of magnitude of the converted pixel signal with respect to the display color of the pixel is equal to the range of magnitude of the digital pixel signal when the maximum gamma voltage with respect to the displaying color of the pixel is a largest one among the maximum gamma voltages for the respective colors.

13. The apparatus according to claim 1, wherein the pixel signal converting unit converts the digital pixel signal into the converted pixel signal so that the range of magnitude of the converted pixel signal is smaller than the range of magnitude of the digital pixel signal when the maximum gamma voltage with respect to the display color of the pixel is not a largest one among the maximum gamma voltages for the respective colors.

14. The apparatus according to claim 1, wherein the gamma correction unit converts the converted pixel signal into the gamma signal according to a corresponding gamma curve with respect to the display color of the pixel.

15. A method for converting a digital pixel signal to a gamma voltage signal, wherein the digital pixel signal corresponds to a pixel in a display panel, the gamma voltage signal is for application to the pixel for a display color, the display color of the pixel is one of a group of colors, a plurality of pixels of the display panel for displaying the respective colors reach respective maximum luminances at respective maximum gamma voltages for the respective colors, the method comprising the steps of:

a. determining the maximum gamma voltages of the respective colors at which the pixels for displaying the respective colors reach the corresponding maximum luminances, where the maximum gamma voltages for the group of colors are not all the same;

b. receiving the digital pixel signal;

c. converting the received digital pixel signal to a converted pixel signal according to the display color of the pixel, wherein the relation between the digital pixel signal and the converted pixel signal is determined according to a display color of the pixel, the magnitude of the converted pixel signal has a range determined according to the displaying color of the pixel, and the range of magnitude of the converted pixel signal with respect to the displaying color of the pixel depends on the maximum gamma voltage at which the pixel reaches the maximum luminance with respect to the displaying color of the pixel;

d. converting the converted pixel signal to the gamma voltage signal by performing gamma correction with respect to the display color of the pixel, wherein when the converted pixel signal indicates a maximum value in the range of magnitude with respect to the displaying color of the pixel, the gamma voltage signal is the maximum gamma voltage at which the pixel reaches maximum light luminance with respect to the displaying color of the pixel; and e. outputting the gamma voltage signal.

16. The method according to claim 15, wherein the display color is selected from the group consisting of red, blue, and green.

17. The method according to claim 16, wherein in said step d, the converted pixel signal is converted to the gamma voltage signal forming a gamma voltage signal range with respect to the display color of the pixel, where the gamma voltage signal range includes:

a first gamma voltage signal that enables the pixel to display the display color in maximum luminance of the pixel if the display color of the pixel is red;

a second gamma voltage signal that enables the pixel to display the display color in maximum luminance of the pixel if the display color of the pixel is blue; and a third gamma voltage signal that enables the pixel to display the display color in maximum luminance of the pixel if the display color of the pixel is green.

18. The method according to claim 17, wherein in said step c, the value of the converted pixel signal is within a converted pixel value range determined by the display color of the pixel.

19. The method according to claim 18, wherein in said step c, the digital pixel signal is converted into the converted pixel signal indicating a maximum value of the converted pixel value range if the digital pixel signal indicates a maximum value.

20. The method according to claim 19, wherein the converted pixel signal indicating the maximum value of the converted pixel value range is converted into the first gamma voltage signal if the display color of the pixel is red.

21. The method according to claim 19, wherein the converted pixel signal indicating the maximum value of the converted pixel value range is converted into the second gamma voltage signal if the display color of the pixel is blue.

22. The method according to claim 19, wherein the converted pixel signal indicating the maximum value of the converted pixel value range is inverted into the third gamma voltage signal if the display color of the pixel is green.

23. The method according to claim 15, wherein the digital pixel signal and the converted pixel signal are both n-bit binary data signals.

24. The method according to claim 15, wherein the method is applied to a driving circuit of the liquid crystal display.

25. The method according to claim 15, wherein in said step d, the converted pixel signal is converted into the gamma voltage signal by performing gamma correction on the basis of a plurality of reference gamma voltage signals.

26. The method according to claim 15, wherein in said step c, the range of magnitude of the converted pixel signal with respect to the display color of the pixel is equal to the range of magnitude of the digital pixel signal when the maximum gamma voltage with respect to the displaying color of the pixel is a largest one among the determined maximum gamma voltages of the respective colors.

27. The method according to claim 15, wherein in said step c, the range of magnitude of the converted pixel signal is smaller than the range of magnitude of the digital pixel signal when the maximum gamma voltage with respect to the display color of the pixel is not a largest one among the determined maximum gamma voltages of the respective colors.

28. The method according to claim 15, wherein in said step d, the converted pixel signal is converted to the gamma signal according to a corresponding gamma curve with respect to the display color of the pixel.

29. A method for converting a digital pixel signal to a gamma voltage signal for a pixel in a display panel, wherein the gamma voltage signal is used for application to a pixel after a last gamma voltage signal is applied to the pixel, and the last gamma voltage signal corresponds to a last digital pixel signal, the method comprising:

receiving the digital pixel signal;

converting the digital pixel signal to a converted pixel signal, the converted pixel signal being equal to a dynamic converted pixel signal if the digital pixel signal and the last digital pixel signal are different in value, wherein the relation between the digital pixel signal and the dynamic converted pixel signal is determined according to a display color of the pixel, the digital pixel signal, and the last digital pixel signal, the converted pixel signal being equal to a static converted pixel signal according to the value of the digital pixel signal if the digital pixel signal and the last digital pixel signal are equal in value, wherein the relation between the digital pixel signal and the static converted pixel signal is determined according to the display color of the pixel;

converting the converted pixel signal to the gamma voltage signal; and outputting the gamma voltage signal.

30. The method according to claim 29, wherein the display color is selected from the group consisting of red, blue, and green.

31. The method according to claim 30, wherein in the step of converting the converted pixel signal to the gamma voltage signal, the converted pixel signal is converted to the gamma voltage signal forming a gamma voltage signal range with respect to the display color of the pixel, where the gamma voltage signal range includes:

a first gamma voltage signal that enables the pixel to display the display color in maximum luminance of the pixel if the display color of the pixel is red;

a second gamma voltage signal that enables the pixel to display the display color in maximum luminance of the pixel if the display color of the pixel is blue; and a third gamma voltage signal that enables the pixel to display the display color in maximum luminance of the pixel if the display color of the pixel is green.

32. The method according to claim 31, wherein the value of the converted pixel signal is within a converted pixel value range determined by the display color of the pixel.

33. The method according to claim 32, wherein the digital pixel signal is converted into the converted pixel signal indicating a maximum value of the converted pixel value range if the digital pixel signal indicates a maximum value.

34. The method according to claim 33, wherein the converted pixel signal indicating the maximum value of the converted pixel value range is converted into the first gamma voltage signal if the display color of the pixel is red.

35. The method according to claim 33, wherein the converted pixel signal indicating the maximum value of the converted pixel value range is converted into the second gamma voltage signal if the display color of the pixel is blue.

36. The method according to claim 33, wherein the converted pixel signal indicating the maximum value of the converted pixel value range is converted into the third gamma voltage signal if the display color of the pixel is green.

37. The method according to claim 29, wherein the digital pixel signal and the converted pixel signal are both n-bit binary data signals.

38. The method according to claim 29, wherein the method is applied to a driving circuit of the liquid crystal display.

39. The method according to claim 29, wherein in the step of converting the converted pixel signal, the converted pixel signal is converted to the gamma voltage signal by performing gamma correction on the basis of a plurality of reference gamma voltage signals.

* * * * *